US008047973B2

(12) United States Patent
Berenshteyn

(10) Patent No.: US 8,047,973 B2
(45) Date of Patent: Nov. 1, 2011

(54) WEIGHTLIFTING APPARATUS FOR PRONATION AND SUPINATION EXERCISES

(76) Inventor: Annaniy Berenshteyn, Ocean, NJ (US)

( * ) Notice: Subject to any disclaimer, the term of this patent is extended or adjusted under 35 U.S.C. 154(b) by 0 days.

(21) Appl. No.: 12/636,347

(22) Filed: Dec. 11, 2009

(65) Prior Publication Data

US 2010/0160124 A1 Jun. 24, 2010

Related U.S. Application Data

(63) Continuation-in-part of application No. 11/493,175, filed on Jul. 27, 2006, now abandoned.

(51) Int. Cl.
*A63B 21/072* (2006.01)
*A63B 21/075* (2006.01)

(52) U.S. Cl. ..... 482/106; 482/93; 482/100

(58) Field of Classification Search ..... 482/92, 482/93, 98, 99, 100, 106, 107, 108
See application file for complete search history.

(56) References Cited

U.S. PATENT DOCUMENTS

| | | | | | |
|---|---|---|---|---|---|
| 3,384,370 | A | * | 5/1968 | Bailey et al. | 482/106 |
| 4,461,473 | A | * | 7/1984 | Cole | 482/106 |
| 4,585,229 | A | * | 4/1986 | Brasher | 482/106 |
| 4,618,143 | A | * | 10/1986 | Twardosz | 482/106 |
| 4,629,184 | A | * | 12/1986 | Selkee | 482/106 |
| 4,743,018 | A | * | 5/1988 | Eckler | 482/106 |
| 4,822,035 | A | * | 4/1989 | Jennings et al. | 482/106 |
| 4,863,158 | A | * | 9/1989 | Tassone | 482/140 |
| 5,024,434 | A | * | 6/1991 | Smith | 482/107 |

* cited by examiner

*Primary Examiner* — Stephen Crow
*Assistant Examiner* — Sundhara Ganesan
(74) *Attorney, Agent, or Firm* — The Farrell Law Firm, P.C.

(57) ABSTRACT

A weightlifting apparatus is operative to continuously provide and adjust a force resistant to a torque produced by an exerciser that performs supination of biceps simultaneously with other exercise motions or pronation of triceps simultaneously with other exercise motions.

4 Claims, 10 Drawing Sheets

WEIGHTLIFTING APPARATUS FOR PRONATION AND SUPINATION EXERCISES

PRIORITY

This application is a continuation in part application of application Ser. No. 11/493,175, filed with the U.S. Patent and Trademark Office on Jul. 27, 2006, the contents of which are incorporated herein by reference.

BACKGROUND OF THE INVENTION

1. Field of the Invention

The present invention relates to a weightlifting apparatus operative to provide a continuous adjustable resistant force to a muscle-generated force produced by an exerciser that performs supination of biceps simultaneously with other exercise motions or pronation of triceps simultaneously with other exercise motions.

2. Description of the Related Art

Weightlifting apparatus for performing simultaneously two exercise motions are well known in prior art. A typical structure representative of these apparatus includes a bar with rotatably attached handles and changeable weights suspended opposite ends of the bar. The structure is configured to allow an exerciser to simultaneously perform, for example, flexing and supination of biceps or extension and pronation of triceps, wherein the supination motion is characterized by turning the palm upward, whereas the pronation motion is performed by turning the palm downward. Typically, such a structure is operative to generate a controllable force resistant only to a force generated by flexing/extending motion, but not to a torque generated by supination/pronation motion. Accordingly, muscle development controlled by the supination and/or pronation motions may be not as effective as desired.

Another type of the known weightlifting devices operative to simultaneously perform the supination/pronation exercises in combination with other exercises is operative to utilize weightlifting resistance to, for example, simultaneously perform biceps flexing biceps supination exercises. While the resistance to flexing motion is provided by using changeable weights, which can be easily selected from a very wide range to correspond to the muscle development level of the exerciser, the resistance to supination is caused by friction between the rotatable and non-rotatable parts of a handle assembly. Such a structure does not provide for an easy adjustment of resistance. Moreover, the adjustments range from near-zero to locking is very small and cannot be consistently reproduced, since there is no quantifiable indication of actual resistance. The level of resistance in such an apparatus is dependent on geometrical tolerances, the surface finishes and wears resistance of the involved parts and, therefore, may vary greatly from one apparatuses to the other or during usable life of the same apparatus. Another disadvantage of these apparatus is determined by the fact that if the motion is stopped, for example, at the point where the direction is changed from lifting to lowering the apparatus, a friction force provides no resistance to the supination motion of muscles. Also, a force resistant to a torque, which is generated during supination motion, is generated only when the exerciser lifts the apparatus, but not when the apparatus is being lowered, since during that part of the motion (to the starting position) the hands of the exerciser are exposed to pronation resistance. As a result, the intended muscles are loaded only during 50% of the exercise motion.

Still in another example of known apparatus for simultaneously performing two exercise motions, a spring-loaded supination/pronation motion unit is operative to generate a variable resistant depending whether a spring is in a contracted state or an expanded state during an exercise. However, it is a constant resistant force that is particularly beneficial the desired muscle development. In thus configured apparatus, during early stages of the lifting operation, a force created by the spring is directed through the center of rotation of both rotatable handles and totally equals to its normal component, whereas the tangential component is equal to zero. When the positions of the rotatable handle changes during the exercise, the spring force no longer passes through the center of both of the rotatable handles. During the rotational motion of the handles the normal component of the resultant force is gradually decreasing and the tangential component is increasing until the handles are rotated at 90° from the initial position. At this point the resultant force is equal to its tangential component, and the normal component is equal to zero. The resistance to be overcome by the muscles during the supination or pronation motion depends only upon the tangential component responsible for the generation of the resistant torque. Since this component constantly changes, the apparatus does not provide for constant resistance, which, as discussed above, is critical to the muscle development.

Yet another type of known apparatus for simultaneously performing two exercise motions, which utilize weightlifting resistance to multiple motions, allows performing only one or a very limited number of exercises and has a complex structure. Furthermore, the device strictly restricts the motion trajectory.

A need, therefore, exists for a weightlifting apparatus that allows the development of muscles by carrying out at least two exercise motions simultaneously under consistent, continuous and adjustable load.

BRIEF DESCRIPTION OF THE DRAWINGS

The above and other features and advantages of the disclosed apparatus will become more readily apparent from a specific description accompanied by the following drawings, in which.

DETAILED DESCRIPTION OF THE PREFERRED EMBODIMENTS

Figure 1:
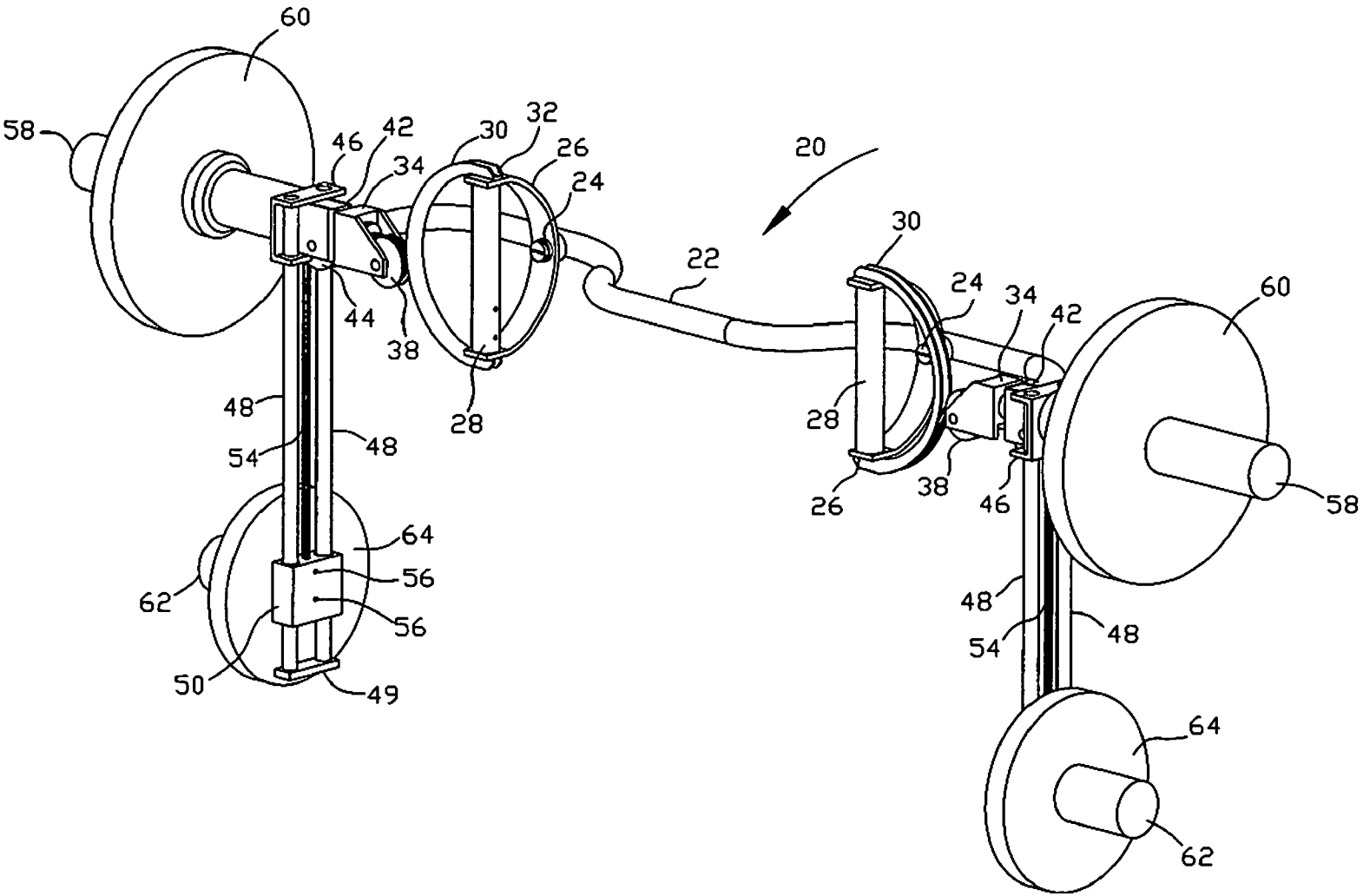
FIG. 1 is a perspective view of a weightlifting apparatus configured in accordance with one embodiment of the invention.

Hereinafter, a preferred embodiment of the present invention will be described in detail with reference to the accompanying drawings. The same reference numerals are used to denote the same structural elements throughout the drawings. In the following description, detailed description of known functions and configurations incorporated herein will be omitted to avoid making the subject matter of the present invention unclear.

Referring to FIG. 1, a weightlifting apparatus 20 is configured in accordance with a first embodiment of the invention and operative to simultaneously perform at least two different exercises involving flexing and supination motions as well as extending and pronation motions. Accordingly, apparatus 20 is configured with two operatively interconnected units including a muscle flexing/extending assembly and a muscle supination/pronation assembly.

The apparatus 20 is configured with an elongated carrying bar 22 having generally C-shaped opposite end regions each provided with spaced apart flanks which are bent approximately at a 90° angle relative to the longitudinal axis of bar 22. The end regions of bar 22 are provided with respective handle units explained in detail hereinbelow and each generally including a yoke 26, a handle 28 and a pulley 30 which lies in a plane extending perpendicular to a plane of yoke 26. The handle units operate independently from each other and each are configured to selectively provide supination and pronation motions in response to a torque generated by the exerciser's forearm. Mounted to the opposite ends of bar 22 and coaxial therewith are rods 58 coupled to weight units 60. The weight units 60 define a load factoring in a biceps/triceps flexing exercise during which the exerciser applies a pulling force to handles 28 causing bar 22 to reciprocally rotate about elbow joints of the exerciser as will be explained in detail hereinbelow. A pair of weight units of the supination/pronation assembly each including weights 64 and coupled to the respective end region of bar 22 between weights 60 provides a resistant force to a torque generated by the exerciser and applied to handles 28 during supination and/or pronation exercises simultaneously with biceps/triceps flexing motion.

Figure 2:
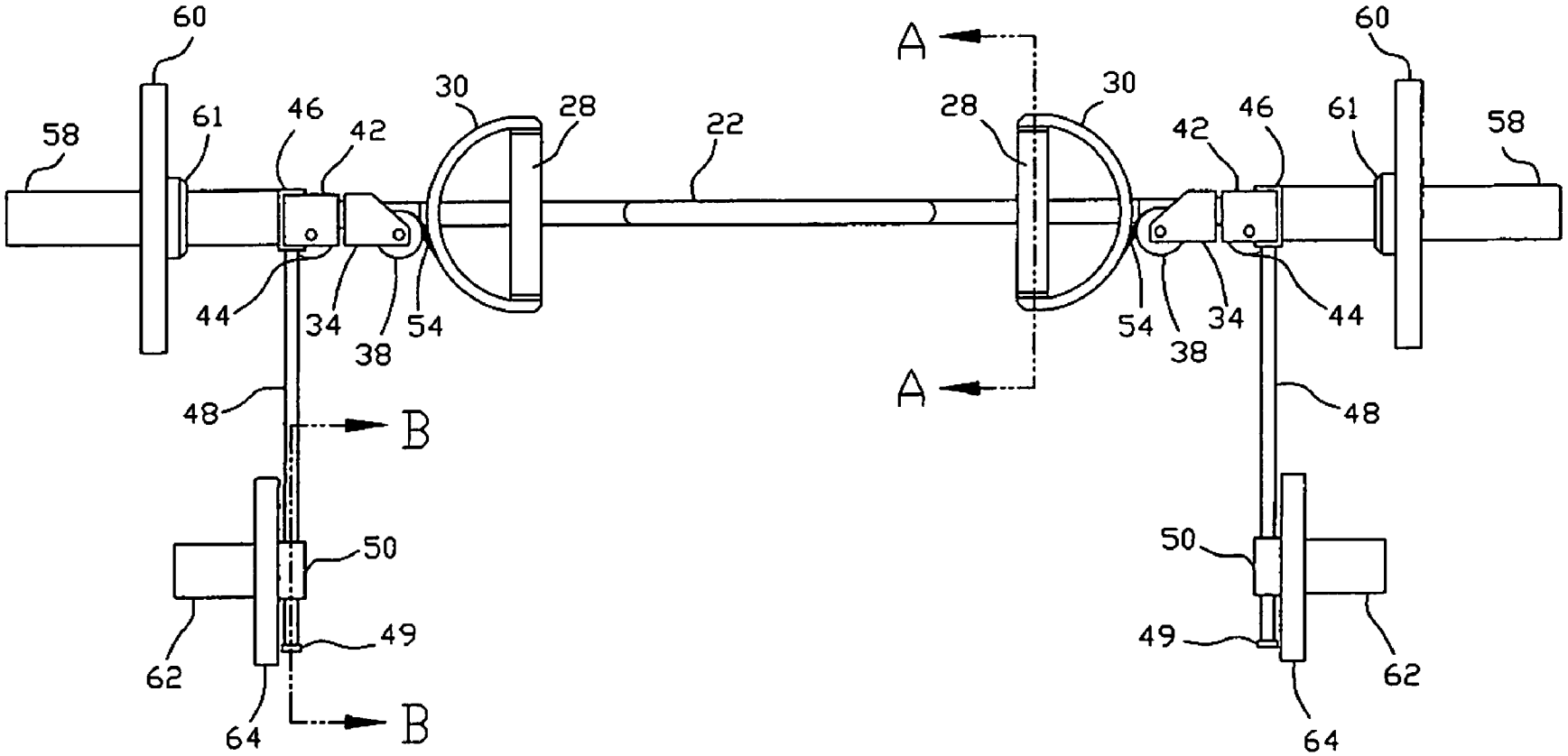
FIG. 2 is a longitudinal view of the weightlifting apparatus of FIG. 1.
Figure 7:
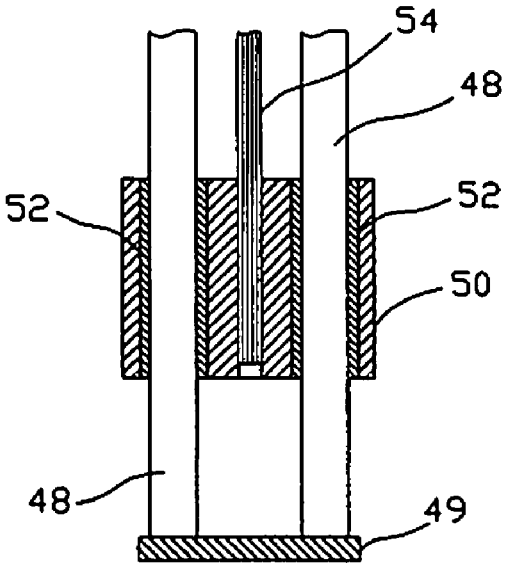
FIG. 7 is a sectional view taken along the line B-B of FIG. 2.

Referring further to FIGS. 2 and 7, the supination/pronation weight units each have a pair of spaced guide shafts 48 extending perpendicular to the longitudinal axis of bar 22 so that their respective upper ends are coupled to a bracket 46 while the lower ends secured together by a plate 49. The guide shafts 48 each are configured to guide weights 64 along a linear vertical path in response to a torque applied by the exerciser to handle 28. The linear motion of weights 64 is realized by means of a carriage 50 displaceably fixed to weights 64 by a rod 62 and slidably mounted to shafts 48 by sliding bearings 52 (FIG. 7).

Figure 4:
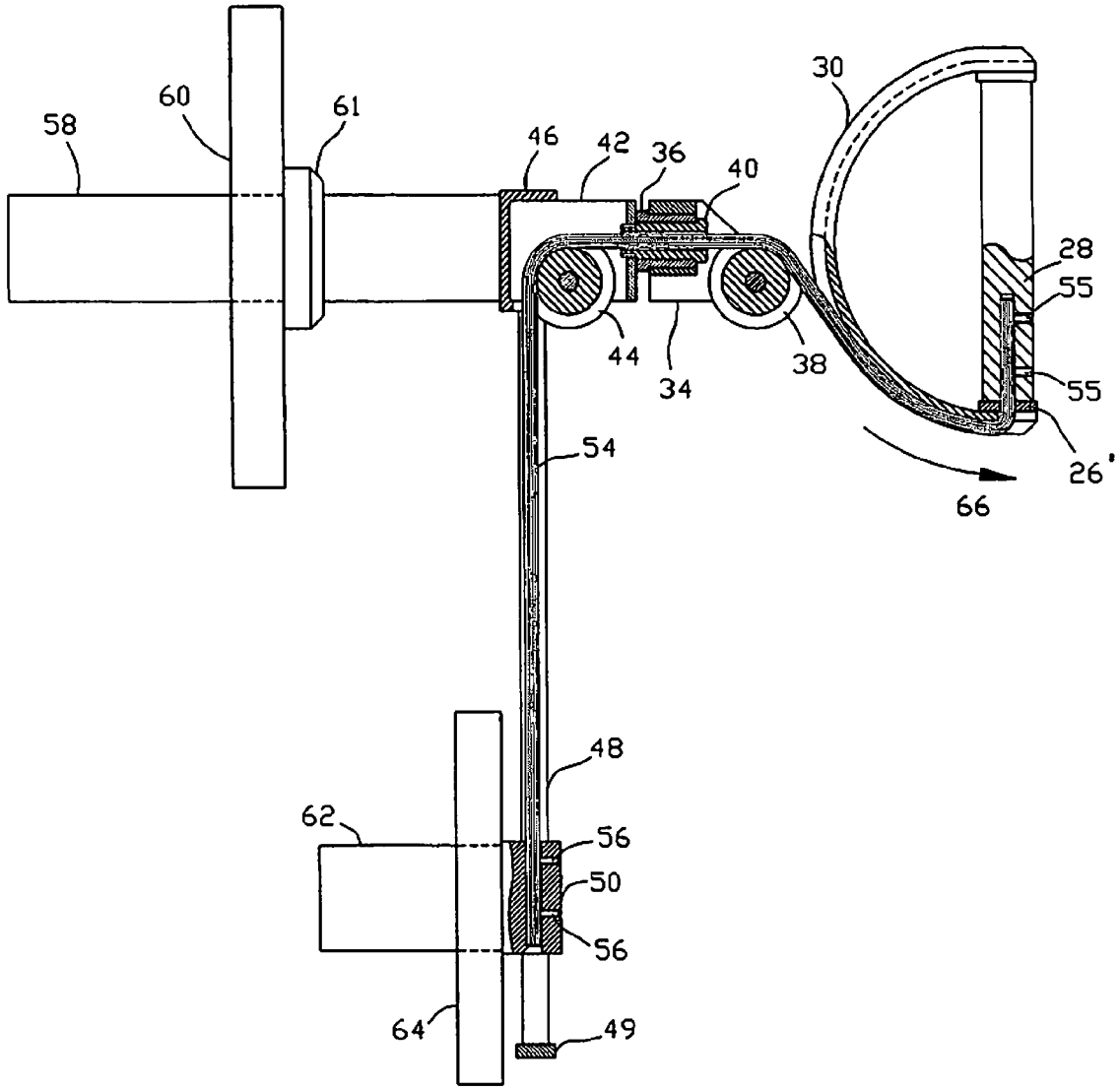
FIG. 4 is a partial sectional view of the left portion of the weightlifting apparatus, which is set for supination exercise motion.

Referring to FIG. 4 in addition to FIG. 1, the supination/pronation assembly includes a force transmission unit operative to convert rotational motion of handle 28 to linear motion of weights 64 and is configured with a system of flexible elements and pulleys. One or more flexible elements 54 of the force transmission unit are secured at one of its ends to handle 28 with screws 55. The other end of flexible elements 54 is secured inside respective carriages 50 with screws 56. The flexible element 54 is guided through a combination of pulleys at least partially housed in a housing 34 which is connected to the extreme bent end of carrying bar 22 (FIG. 1). The housing 34 has a central channel to receive a bearing 36, rotatably supporting a hollow shaft 40, and is displaceably fixed to bar 22. The rotatable hollow shaft 40 is traversed by a stretch of flexible element 54 guidable so that, regardless of the angular position of bar 22, weights 64 are driven in a plane perpendicular to the longitudinal axis of bar 22. One end of housings 34 has a U-shaped portion rotatably supporting a pulley 38. The end of hollow shaft 40 protrudes outside bearing 36 and is attached to a yoke 42. A pulley 44 is rotatably mounted inside yoke 42, which, in turn, is coupled to bracket 46. The flexible element 54 is trained through a groove of pulley 44, hollow shaft 40, a groove of pulley 38, and further through a groove 32 (FIG. 1) of pulley 30, which, in turn, is coupled to yoke 26 that is rotatably mounted to handle 28 by means of axle 24.

Figure 6:
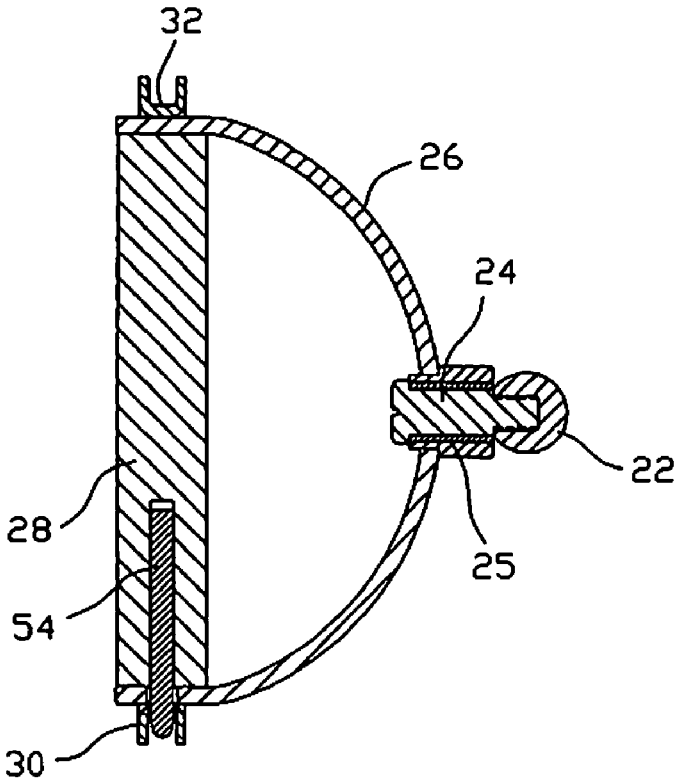
FIG. 6 is a sectional view taken along the line A-A of FIG. 2.

Turning to FIG. 6 in addition to FIG. 1, yoke 26 of the handle assembly has a central opening configured to receive coaxially disposed bearing 25 and axle 24 which extends transversely to bar 22 and is displaceably fixed thereto. Since bearing 25 is juxtaposed between yoke 26 and axle 24, handle 28, displaceably fixed to yoke 26, is rotatable about axle 24 in response to a torque applied by the exerciser. Concomitantly, pulley 30, displaceably fixed to handle 28 and having a central axis which extends substantially perpendicular to axle 24 and parallel to the axis of bar 22, rotates about axle 24 in response to the exerciser-generated torque. The groove 32 (FIG. 1) of pulley 30 and the groove of pulley 38 are aligned while pulley 30 rotates. As a consequence a transition region in which flexible element 54 leaves pulley 38 and enters pulley 30 remains spatially fixed so as to maintain the desirable vertical linear path of weights 64 providing, thus, a continuous load on biceps during supination motion. All of the pulleys may have a variety of configurations including a round shape or semi-circle shape or any other irregular shape with a curved stretch. For example, pulley 30 may have the shape of a complete circle or a partial circle, with the central angle of the partial circle generally larger than the angle of the user's hand rotation during the pronation or supination phase of the exercise.

In operation, weightlifting apparatus 20 may be utilized in one of two modes: for primary flexion and supination of the biceps muscles; for extension and pronation of triceps muscles.

For exercises such as curl, preacher curl, upright row, and bent-over row that involve flexion and supination motion, weightlifting apparatus 20 as shown in FIG. 2 and FIG. 4 is provided, with ends of flexible elements 54, attached to the handles 28, located below the central axis of rotation of pulleys 30. The exerciser places his/her hands on handles 28 to lift bar 22 upwards, typically by a flexing motion of the biceps via bending the arms at the elbow, where first weights 60 and the total weight of the apparatus, including second weights 64, provide the resistance to the flexing motion of the biceps. Simultaneously with flexing motion, the exerciser rotates handles 28 around respective axles 24 in a direction of arrow 66 (FIG. 4). This motion generates a pulling force causing second weights 64 to move upwards along with carriages 50 and flexible element 54, thereby providing resistance to a torque generated by the exerciser during the flexion/supination motion of the biceps. Since the transition region between pulleys 38 and 30 remains spatially fixed, as explained above, regardless of the angular positions of bar 22 and handle 28, second weights 64 always runs along the desired linear path that includes the vertical and horizontal stretches so as to provide maximum effectiveness of the flexion/supination motion regardless of a rotational sense of handle 28 and bar 22.

Figure 3:
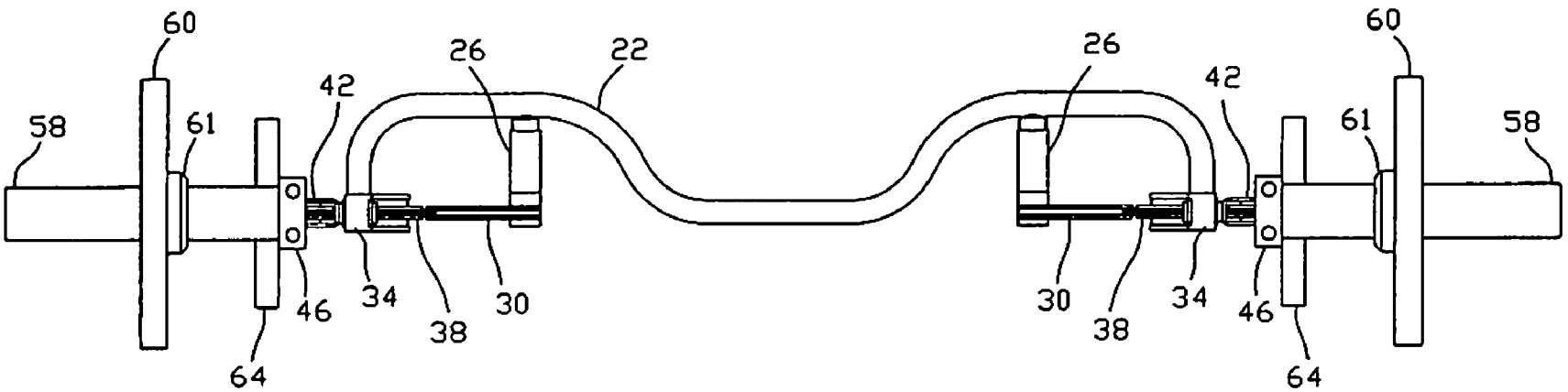
FIG. 3 is a top plan view of the weightlifting apparatus of FIG. 1.
Figure 5:
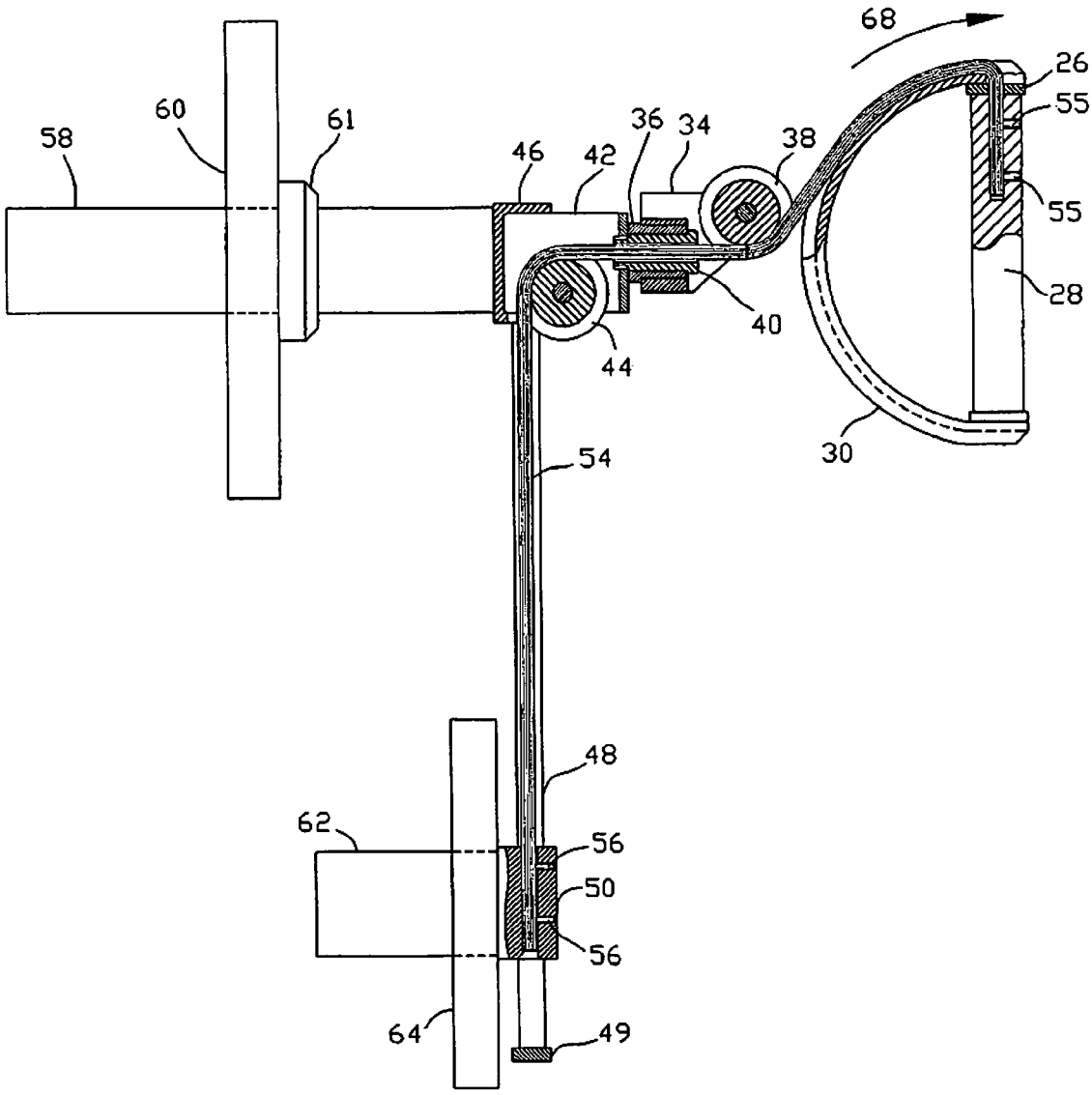
FIG. 5 is a partial sectional view of the left portion of the weightlifting apparatus of FIG. 1, which is set for pronation exercise motion.

For exercises that involve extension and pronation of triceps, such as barbell triceps extension, lying triceps extension, bench press, incline bench press, military press, behind neck press, etc., weightlifting apparatus 20 must be set in the rest position shown on FIG. 5. To reach this position, bar 22, housing 34 along with pulley 38 are rotated at a 180° angle relative to the longitudinal axis of bar 22 to position the ends of flexible elements 54, which are attached to respective handles 28, above the central axis of rotation of pulleys 30. Thus, for extension/pronation exercises, bar 22 is rotated at an oblique angle from the rest position associated with flexing/supination motions, as shown in FIG. 3. Since housing 34 is rotatably fixed with bar 22, housing 34 rotates as a substantially 180 degree angle to a position shown in FIG. 5. Displacement of housing 34 brings pulley 38 to a position in which a stretch of the flexible element enters pulley 30 along a clockwise rotational direction 68, opposite to the position shown in FIG. 4 for supination exercises. The exerciser then lifts bar 22 so that handles 28 are positioned on his/her shoulders and starts extending his arms thereby rotating bar 22 in a direction opposite to that used for supination exercises. As a result, weight plates 60 and the total weight of the apparatus provide the resistance to the extension motion of the triceps. Simultaneously with the pulling force, the exerciser generates a torque applied to handles 28 so as to rotate the handles around respective axels 24 in the direction of arrow 68. This motion causes weight plates 64 to be pulled up through flexible elements 54 and carriages 50, providing resistance to the pronation motion of the triceps. Here, like in the structure of FIG. 4, a transition region between pulleys 38 and 30 does no change its location regardless of the angular position of bar 22 as well as that one of handle 28. This, in turn, provides effective pronation motion accompanied by a resistant force which is generated by weight plates 64 and always directed perpendicular to the longitudinal axis of bar 22.

Figure 8:
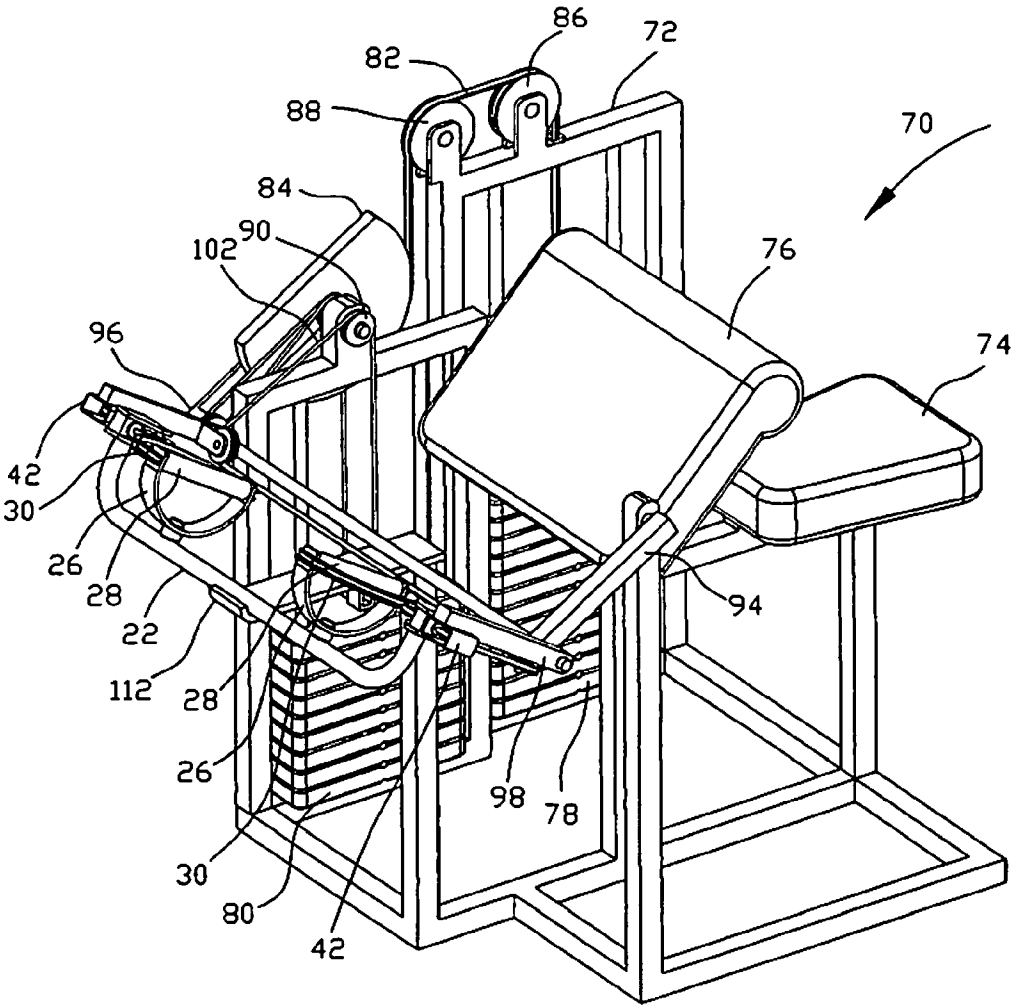
FIG. 8 is a perspective view the weightlifting apparatus configured in accordance with a further embodiment of the invention.

FIG. 8 illustrates a further embodiment a weightlifting apparatus 70 which only allows exercises involving simultaneous flexion and supination of biceps. The apparatus 70 has a base frame 72 supporting a seat 74 and an arm support 76 slanted downwards, as shown in FIG. 8. Arms 94 and 96 extending parallel to one another are fixed to the respective opposite sides of frame 72 and have their respective distal ends each pivotally coupled to an arm 98 which extends angularly upwards from the distal end of arms 94. The distal ends of arms 98 are displaceably fixed to the respective bent ends of carrying bar 22. Spaced apart handle units, configured analogously to the handle unit of FIGS. 1-7, are rotatably mounted to carrying bar 22 and each include handle 28, yoke 26 rotatably mounted to bar 22 and pulley 30 having a central axis which extends perpendicular to axles 24. Upon lowering bar 22 to it lowermost position, it rests on a support 112, as shown in FIG. 8.

A muscle flexing assembly configured to provide resistance to the flexion of biceps includes a stack of weight plates 78, a flexible element 82 with one end displaceably fixed to the top weight plate and the other end trained through upper segments of respective pulleys 86, 88 and fixed to a lower segment of a pulley 84. All three pulleys 84, 86 and 88 have respective axes of rotation extending parallel to one another and generally parallel to a longitudinal axis of bar 22.

A supination assembly includes a stack of weight plates 80, which provides a continuous and adjustable force resistant to a torque generated by the exerciser and applied to handles 28. As in the previously disclosed embodiment, weights 80 move along a path including vertical and horizontal stretches regardless of the angular position of handles 28 and bar 22. A force-transmitting assembly of the supination assembly is operative to convert the exerciser-generated torque to a linear motion of weight plates 80, via a combination of pulleys and a flexible element trained through the pulleys and coupled to weights 80, as explained hereinbelow.

In a preferred embodiment, the force transmitting assembly includes a housing mounted to the bar and receiving the hollow element, and a plurality of pulleys for displacing the flexible element in response to the torque applied to the handle assembly, one of the pulleys being displaceably fixed to the housing and rotatable about a pulley axis parallel to the handle axis, the one pulley being juxtaposed with the handle assembly so that a sub-stretch of the horizontal stretch of the flexible element, extending between the one pulley and the handle assembly, lies in a plane extending at a first negative constant angle relative to the axle axis during rotation of the bar and the handle assembly in the respective one rotational directions, and at a second positive constant angle relative to the in handle axis in the respective opposite rotational directions to maintain a vertical position of the weight unit, wherein the first and second angles are equal to one another. In a preferred embodiment, the housing rotates relative to the yoke between a first position, in which the flexible element enters the handle assembly below the handle axis of the handle assembly at the first negative angle to allow an exerciser to simultaneously perform supination and muscle flexing motions, and a second position in which the flexible element enters the handle assembly above the handle axis at the positive angle of the handle assembly to allow the exerciser to simultaneously perform pronation and muscle extension motions.

Figure 9:
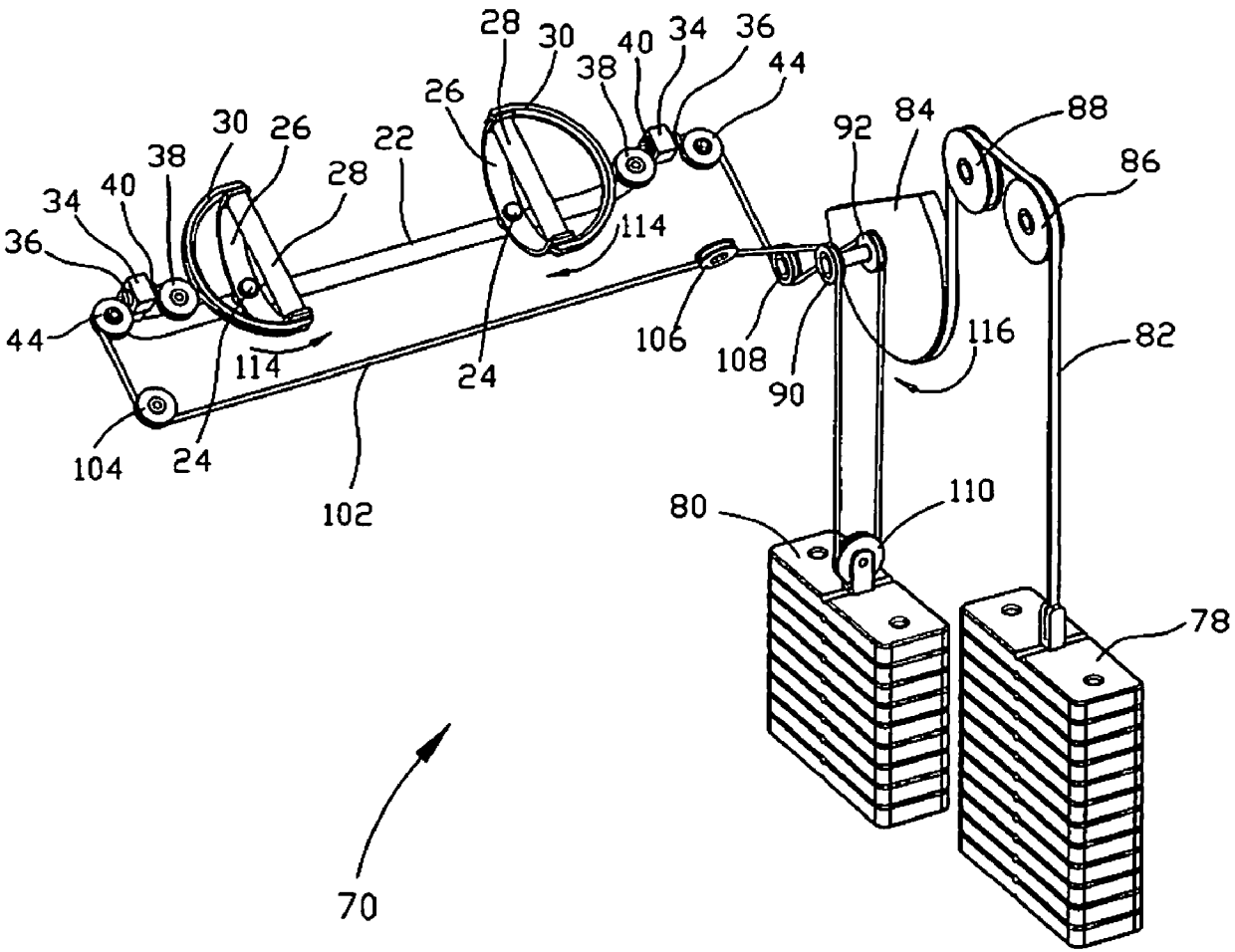
FIG. 9 is a perspective view of the weightlifting apparatus of FIG. 8 set for simultaneously performing a combination of supination and flexing exercises.

Referring to FIG. 9 in addition to FIG. 8, a pulley 110 of the supination assembly is rotatably mounted to the top plate of weights 80 and is wrapped around by a flexible element 102 opposite ends of which are secured to respective yokes 30 of the handle assembly. Mounted concentrically with and displaceably fixed to pulley 84 are spaced pulleys 90 and 92 which are engaged by respective stretches of flexible element 102. One of the stretches of flexible element 102 is further trained through a grooved pulley 108, which rotates about an axis parallel to the axes of respective grooved pulleys 90 and 92, and further through spaced grooved pulleys 44 and 38. The pulleys 38 and 44 rotate about respective parallel axes which extend perpendicular to the axis of pulley 108. Such a configuration allows the end of flexible element 102 to locate below the central axis of pulley 30 regardless of the position of the latter which changes as handle 28 rotates in response to the exerciser-generated torque.

The other stretch of flexible element 102 extends from pulley 90 through a grooved pulley 106 rotatable about an axis perpendicular to the axes of respective pulleys 44 and 38 and to pulley 108 and further to a grooved pulley 104 rotatable about an axis parallel to the axes of respective pulleys 38 and 44. The pulleys 104 and 106, defining therebetween a portion of the flexible element's stretch parallel to bar 22, are positioned to define respective 90° turns along the path. Further, flexible element 102 extends parallel to the longitudinal axis of bar 22 through a grooved pulley 104. Finally, this stretch of flexible element 102 is trained through spaced pulleys 44 and 38 located on the end of bar 22 so that the end of element 102 leaving pulley 38 and entering grooved pulley 30 of handle 28 is spatially fixed regardless of the handle's position. The pulleys 44 and 38 rotate about respective axes parallel to the axis of pulley 104 and flank housing 34 configured to receive hollow shaft 40 (FIG. 9).

The housing 34, as disclosed in detail in reference to FIGS. 1-7, has a central hole shaped and dimensioned to receive bearing 36, which surrounds shaft 40 rotatable relative to housing 34, and a U-shaped portion receiving pulley 38. The ends of hollow shaft 40 protrude outside respective bearings 36 and each coupled to yoke 42 (FIG. 8) housing pulley 44.

To perform the exercise, the user places hands on the handles 28 with arms resting on arm support 76. While pivoting the apparatus in a direction of arrow 116 (FIG. 9) so that weight plates 78 provide the resistance to the flexing motion of the biceps, the exerciser simultaneously rotates handles 28 around respective axels 24 in the direction of arrows 114. This motion causes the weight plates of weight stack 80 to be pulled up through flexible elements 102, always traveling along a vertical linear path and providing resistance to the supination motion of the biceps.

Figure 10:
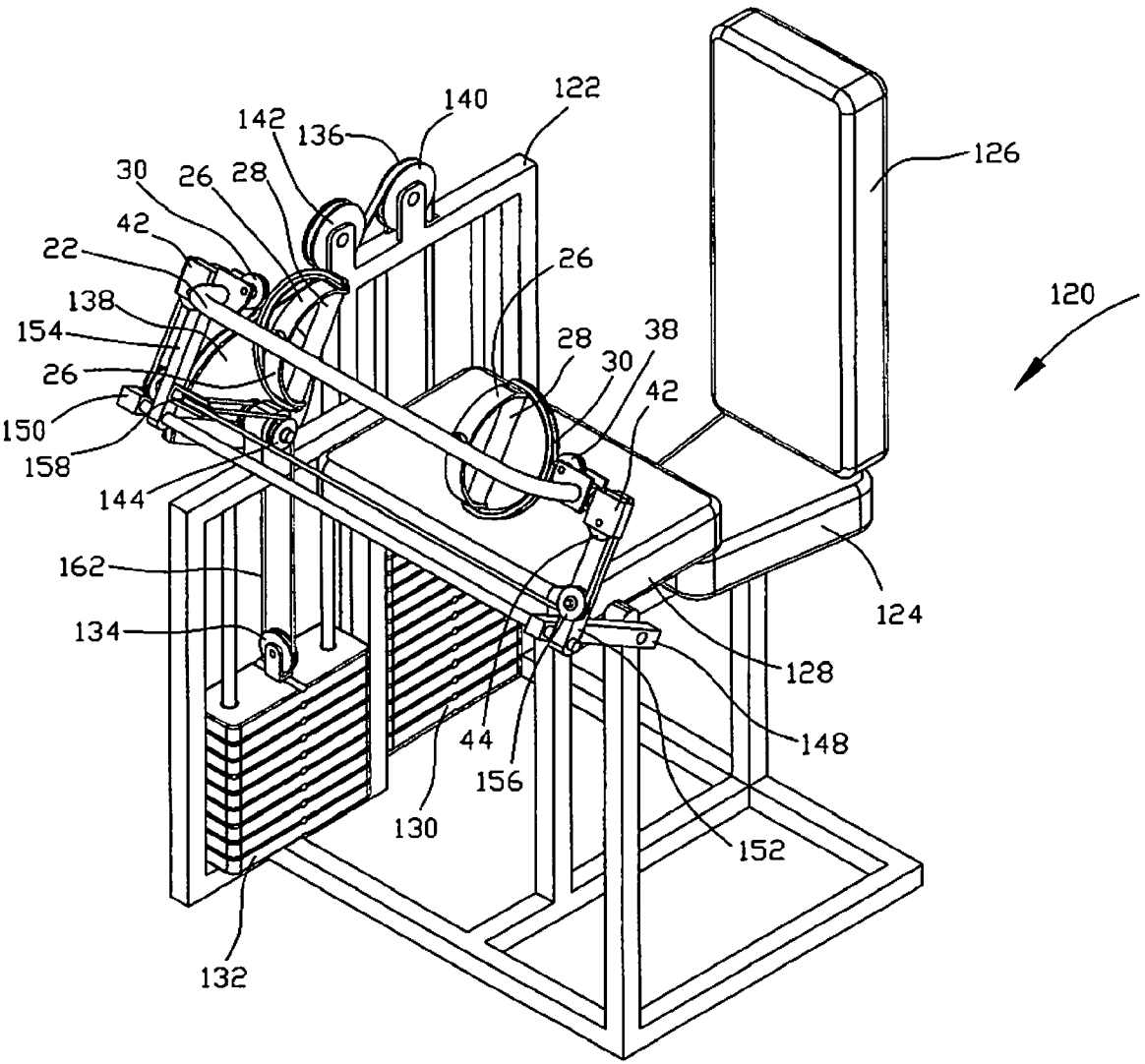
FIG. 10 is a perspective view the weightlifting apparatus configured in accordance with still another embodiment of the invention.
Figure 11:
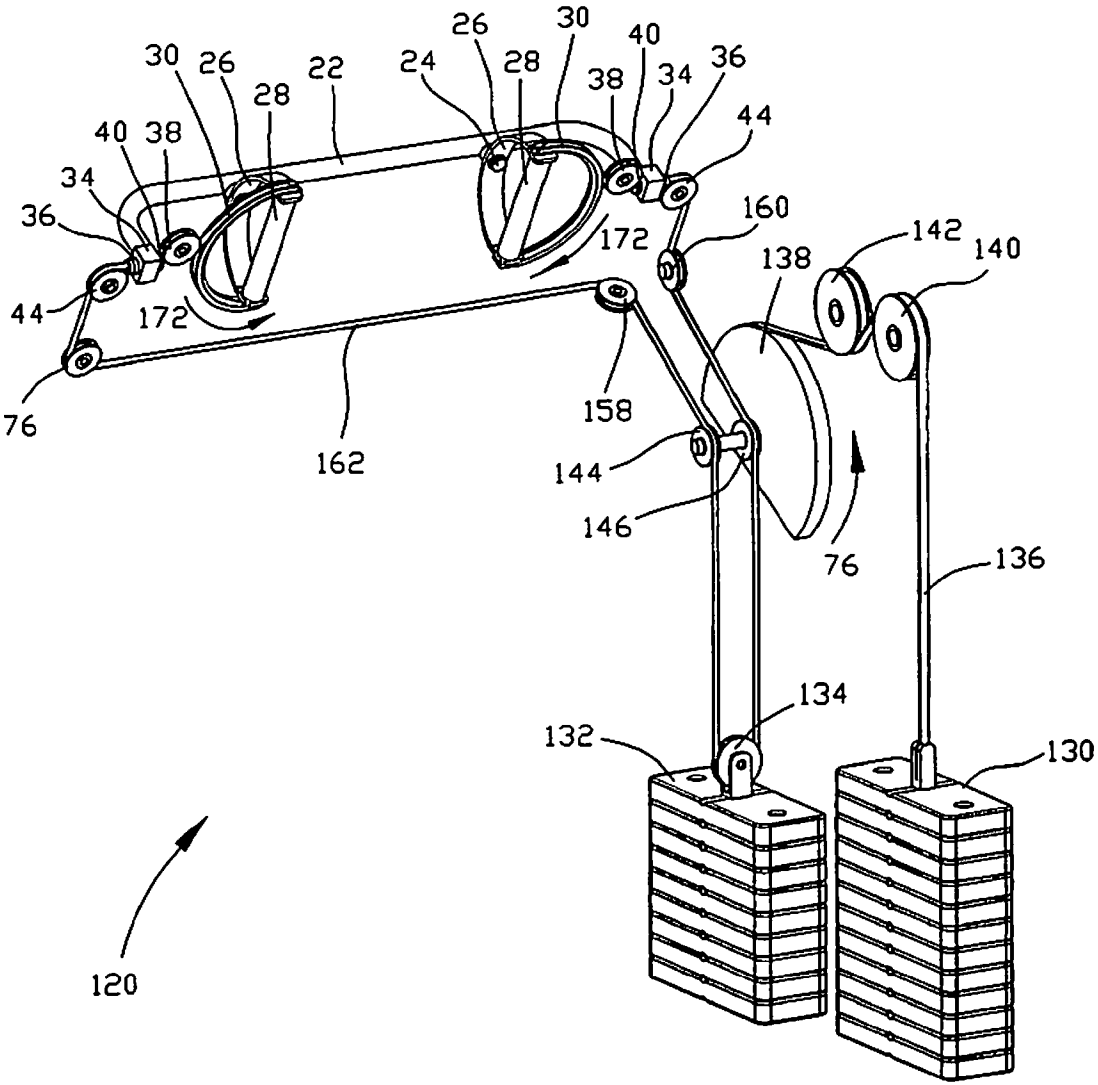
FIG. 11 is a perspective view of still of the weightlifting apparatus of FIG. 10 set for simultaneously performing a combination of pronation and flexing exercises.

FIGS. 10 and 11 show an apparatus 120 operative to simultaneously perform extension and pronation of triceps exercises. The basic structure of this apparatus is similar to the one shown in FIG. 9. However, in contrast to the previously disclosed embodiment for a supination exercise, a flexible element 136 of the flexing assembly of apparatus 120 has one end fixed a stack of weights 130, whereas the opposite end is trained through opposite upper and lower stretches of respective pulleys 140 and 142 and fixed to the upper curved segment of pulley 138. Still a further structural distinction of apparatus 120 is characterized by a position of pulley 38 juxtaposed with pulley 30 of the handle unit so that it is located above the central axis of pulley 30.

To perform the exercise, the exerciser places hands on the handles 28 and rests his elbows on arm support configured analogously the arm support of FIGS. 8 and 9. While pushing bar 22 in the direction of arrow 76 (FIG. 10) so that the weight plates of weight stack 130 provide the resistance to the extension motion of the triceps, user simultaneously rotates the handles around the axis of the axels 24 in the direction of arrows 172. This motion causes a flexible element 162 trained through grooved pulleys 30, 38, 36, 76, 158, 144 134, 146, 160, 44, 38 and 30 in a manner explained above to guide weight plates of weight stack 132 along a vertical path in response to a torque applied by the exerciser to handles 28.

The inventive apparatus is suitable for a variety of body building exercises, such as barbell exercises that involve movement of hands and arms of the exerciser. A non-exclusive list of such as barbell exercise includes barbell biceps curl, barbell reverse curl, preacher curl, upright row, bent-over row, barbell triceps extension, lying triceps extension, flat bench press, incline bench press, decline bench press, military press, behind neck press, barbell front raises, barbell pullover, and barbell bent arm pullover.

While the invention has been shown and described with reference to the preferred embodiments thereof, it will be understood by those skilled in the art that various changes in form and details may be made therein without departing from the spirit and scope of the invention as further defined by the appended claims.

What is claimed is:

1. A weightlifting apparatus comprising:

a carrying bar on which a first weight is mounted; and a plurality of handle assemblies coupled to the carrying bar, wherein each handle assembly rotates about a respective handle axis in response to an exerciser-generated torque, with each handle axis extending transversely to a longitudinal axis of the carrying bar, wherein each handle assembly generates a force resistant to the exerciser-generated torque, wherein the generated force lifts a second weight supported from the carrying bar, wherein the second weight moves relative to the first weight when the exerciser applies the force resistant to the exerciser-generated torque, and wherein the force resistant to the exerciser-generated torque is constant over an entire range of motion of the handle assembly.

2. The apparatus of claim 1, further comprising:

a flexible element attached at a first end of each handle assembly; and the second weight coupled to an other end of the flexible element and slidable along a vertical rod in response to the force applied to the handle assembly.

3. An exercise method involving a weightlifting apparatus having a carrying bar, a plurality of handle assemblies coupled to the carrying bar and a second weight supported from the carrying bar, the method comprising:

lifting the carrying bar upon which a first weight is mounted;

rotating the handle assembly coupled to the carrying bar, wherein the handle assembly extends transverse to a longitudinal axis of the carrying bar and the handle assembly rotates about a handle axis in response to an exerciser-generated torque; and generating, by the handle assembly, a force resistant to the exerciser-generated torque, wherein the generated force lifts the second weight, and wherein the second weight moves relative to the first weight when the exerciser applies the force resistant to the exerciser-generated torque.

4. The method of claim 3, wherein the force resistant to the exerciser-generated torque is constant over an entire range of motion of the handle assembly.

* * * * *